United States Patent [19]

Klimpel et al.

[11] Patent Number: 4,830,740

[45] Date of Patent: May 16, 1989

[54] PYRITE DEPRESSANTS USEFUL IN THE SEPARATION OF PYRITE FROM COAL

[75] Inventors: Richard R. Klimpel; Robert D. Hansen, both of Midland, Mich.

[73] Assignee: The Dow Chemical Company, Midland, Mich.

[21] Appl. No.: 183,577

[22] Filed: Apr. 19, 1988

[51] Int. Cl.[4] ..... B03D 1/02

[52] U.S. Cl. ..... 209/167; 44/625; 252/61

[58] Field of Search ..... 209/166, 167; 44/625; 252/61

[56] References Cited

U.S. PATENT DOCUMENTS

| | | | |
|---|---|---|---|
| 2,740,522 | 4/1956 | Aimone et al. . | |
| 3,796,308 | 3/1974 | McIlhinney et al. . | |
| 3,807,557 | 4/1974 | Miller . | |
| 3,908,912 | 9/1975 | Irons et al. . | |
| 3,919,080 | 11/1975 | Stauter . | |
| 3,938,966 | 2/1976 | Kindig et al. . | |
| 4,126,278 | 11/1978 | Manfroy et al. . | |
| 4,162,044 | 7/1979 | Manfroy et al. . | |
| 4,162,966 | 7/1979 | Finch | 209/166 |
| 4,167,397 | 9/1979 | Grant . | |
| 4,198,291 | 4/1980 | Yoo et al. . | |
| 4,211,642 | 7/1980 | Petrovich . | |
| 4,222,861 | 9/1980 | Finch | 209/166 |
| 4,222,862 | 9/1980 | Finch | 209/166 |
| 4,261,699 | 4/1981 | Sun et al. . | |
| 4,270,926 | 6/1981 | Burk, Jr. et al. . | |
| 4,272,250 | 6/1981 | Burk, Jr. et al. . | |
| 4,274,599 | 6/1981 | Manfroy et al. . | |
| 4,297,108 | 10/1981 | Horowitz et al. . | |
| 4,324,560 | 4/1982 | Fonseca . | |
| 4,340,467 | 7/1982 | Wang | 209/166 |
| 4,388,181 | 6/1983 | Rainis et al. . | |
| 4,448,584 | 5/1984 | Masologites et al. . | |
| 4,536,372 | 8/1985 | Burgess et al. . | |
| 4,537,599 | 8/1985 | Greenwald, Sr. . | |
| 4,564,369 | 1/1986 | Burgess | 209/166 |
| 4,589,980 | 5/1986 | Keys | 209/166 |

FOREIGN PATENT DOCUMENTS

| | | | |
|---|---|---|---|
| 1084638 | 8/1980 | Canada | 209/166 |
| 20275 | 12/1980 | European Pat. Off. | 209/167 |
| 3105582 | 2/1981 | Fed. Rep. of Germany | 209/167 |
| 2163975 | 3/1986 | United Kingdom | 209/166 |
| 2171929 | 9/1986 | United Kingdom | 209/166 |
| 2174019 | 10/1986 | United Kingdom . | |

OTHER PUBLICATIONS

Y. A. Attia, Fossil Fuels Utilization: Environmental Concerns, pp. 21–29 (American Chemical Society 1986).

Chernosky et al., *Transactions of AIME,* 252 11–14 (1972).

Woodburn et al., *Filtr.* Sep. 1987, 24(2), 89–90, 92–96.

Perry et al., *Coal Sci. Technol.* 1985, 9(Process. Util. High Sulfur Coals), 215–238.

Baker et al., *U.S. Clearinghouse Fed. Sci. Tech. Inform.,* PB Rep. 1971, No. 200700.

*Primary Examiner*—Kenneth M. Schor
*Assistant Examiner*—Thomas M. Lithgow
*Attorney, Agent, or Firm*—Paula S. Ruhr

[57] ABSTRACT

The separation of coal from pyrite is enhanced by the use of an effective amount of a polymeric acid or salt thereof as a pyrite depressant in conventional flotation processes. The polymeric acid may be a carboxylic or sulfonic acid. An example of a salt of a polymeric acid useful in the process is sodium polyacrylate.

17 Claims, No Drawings

PYRITE DEPRESSANTS USEFUL IN THE SEPARATION OF PYRITE FROM COAL

BACKGROUND OF THE INVENTION

This invention relates to the separation of sulfur-containing compounds from coal by froth flotation techniques.

Many coals contain relatively large amounts of sulfur ranging generally from less than one percent to as high as about 6 percent. Inorganic sulfur, which is predominantly in the form of pyrite ($FeS_2$), generally accounts for about 40 to 80 percent of the sulfur in most coals. The inorganic sulfur is present in macroscopic and microscopic forms. The macroscopic form is generally present as veins, lenses, nodules or beds while the microscopic form occurs as finely disseminated particles which may be as small as one or two microns in diameter. The balance of the sulfur present in the coal is organic sulfur. The organic sulfur is typically present as mercaptans and sulfides and is incorporated into the coal structure itself.

Air pollution resulting from the burning of sulfur-containing coals is becoming of increasing concern due to the acid rain problems experienced in various parts of the world. The sulfur dioxide emitted when sulfur-containing coals are burned is thought to be a major factor in the acid rain problem. Various approaches to limiting the amount of sulfur dioxide emitted when sulfur-containing coal is burned have been investigated. One approach is to remove the sulfur dioxide from flue gases resulting from burning sulfur-containing fuels such as the process described in U.S. Pat. No. 4,612,175. Other approaches are directed to removing the sulfur from the coal before it is burned. Since the organic sulfur is typically extremely difficult to remove from the coal, the major portion of efforts in this area have been focused on the removal of the inorganic sulfur from coal.

One approach to the removal of inorganic sulfur from coal is flotation. Flotation is a process of treating a mixture of finely divided raw coal suspended in a liquid. Flotation allows the separation of the desired solid, coal, from undesired finely divided solids, gangue, such as pyrite and ash that are also present in the liquid. A gas is introduced into the liquid or created in situ to provide a frothy mass. This frothy mass will contain certain of the solids and carry these to the top of the liquid with the froth and leave other solids suspended in the liquid. Flotation is based on the principle that introducing a gas into a liquid containing different solid particles causes the selective adherence of some gas to part of the suspended solids and not to others. The particles adhering to the gas are lighter than the other solids and thus are floated to the surface while other particles not adhering to the gas remain suspended in the liquid. The selective adherence of the gas to some of the solid particles, but not to others, is due to physical, chemical or surface differences in the solid particles.

Coal is normally hydrophobic in an aqueous mixture That is, coal particles do not wet easily with water and therefore have some natural tendency to adhere to the gas bubbles. Various chemical additives are used in coal flotation to enhance the tendency of coal to float. Collectors, one type of these chemical additives, are commonly used to encourage the natural hydrophobicity of the coal. The collector increases the efficiency with which the gas bubbles attach to the coal. In situations wherein the coal is oxidized or otherwise difficult to float, a promoter may be added in addition to the collector to promote its efficiency. Another important chemical component, usually employed in coal flotation, is a frother which helps to control the rate and efficiency of the contact between bubbles and particles: of the adherence of the particle to the bubble; and of the removal of the bubble and particle from the liquid.

In addition to the use of chemical additives, a necessary part of any successful coal flotation process requires sufficient size reduction of the raw coal particles prior to actual flotation. The size reduction is necessary so that the majority of coal and the various gangue solids present exist as physically distinct particles (liberated particles) or as particles existing in a loose agglomeration Only when the particles exist in this state are the chemical additives discussed above successful in separating coal from gangue.

When the coal and the various gangue particles possess similar characteristics, it becomes difficult to separate them using simple flotation. When the differences in the characteristics of the solid particles are small or when the desirable and gangue solids both tend to float as is often the case with coal and pyrite in practice, it is necessary to use various methods to create or enhance the differences in the particles so that separation by flotation may be accomplished. Various techniques and processes exist to accomplish this.

One technique used to separate coal from inorganic sulfur-containing compounds in flotation processes focuses on the use of depressants to depress the flotation of either the coal or the inorganic sulfur-containing compound. A depressant is an agent that, when added to the flotation system, exerts a specific action on the material to be depressed thereby preventing it from floating. Various theories have been put forth to explain this phenomenon. Some of these include: that the depressants react chemically with the mineral surface to produce insoluble protective films of a wettable nature which fail to react with collectors: that the depressants, by various physical-chemical mechanisms, such as surface adsorption, mass-action effects, complex formation or the like, prevent the formation of the collector film: that the depressants act as solvents for an activating film naturally associated with the mineral: and that the depressants act as solvents for the collecting film. These theories appear closely related and the correct theory may eventually be found to involve elements of most or all of these and more.

U.S. Pat. No. 3,919,080 teaches that the flotation of inorganic sulfur as pyritic sulfur in the aqueous flotation of coal particles is depressed by the addition of sulfite to the flotation pulp. U.S. Pat. No. 3,807,557 discloses that pyrite is removed from coal in a two-stage flotation process. The conventional first flotation is followed by a second stage which uses an organic colloid as a depressant for the coal. The use of polyhydroxy alkyl xanthate depressants to depress the flotation of pyrite in coal flotation is taught in U.S. Pat. No. 4,211,642. Great Britain patent application 2,174,019A teaches that a compound which has one group capable of adhering to the surface of a hydrophilic mineral which group is bonded to a second group which is polar in nature and has hydrophilic properties is useful in coal flotation to depress the flotation of pyrite.

Many approaches have been suggested for the separation of inorganic sulfur from coal. However, the methods suggested are not without problems. Some of these problems include the removal of insufficient quantities of inorganic sulfur from the coal and lower overall coal recoveries. Thus, what is needed is a process for the separation of coal from sulfur that is inexpensive and simple to use and that significantly reduces the amount of inorganic sulfur remaining with the coal while not adversely affecting coal recovery.

SUMMARY OF THE INVENTION

The present invention is such a process for the separation of inorganic sulfur-containing compounds from coal in a process for the flotation of coal. This process comprises subjecting raw coal which contains inorganic sulfur-containing compounds, in the form of an aqueous slurry, to a froth flotation process in the presence of an amount of a polymeric acid, which contains a plurality of anionic moieties, or a salt thereof, effective to depress the flotation of the inorganic sulfur-containing compounds thus facilitating the separation of these sulfur-containing compounds from the coal.

The polymeric acids or salts thereof of this invention surprisingly selectively depress inorganic sulfur-containing compounds while not adversely affecting coal recovery.

DETAILED DESCRIPTION OF ILLUSTRATIVE EMBODIMENTS

The polymeric acids or salts thereof useful in the practice of this invention include any inherently liquid-dispersible polyelectrolyte having a hydrocarbon backbone bearing a plurality of pendant anionic moieties. It is preferred that these anionic moieties are selected from the group consisting of carboxylic and sulfonic moieties. Examples of suitable, but less preferred anionic moieties include phosphonic moieties. In addition to these anionic moieties, the hydrocarbon backbone may also have pendant nonionic moieties. Non-limiting examples of such nonionic moieties include amide and ester substituents.

Preferred polymeric acids include the water-dispersible polymers or salts thereof of anionic monomers such as $\alpha,\beta$-ethylenically unsaturated acids including, as examples, styrene sulfonic, 2-acrylamido 2-methyl propanesulfonic, acrylic, methacrylic, fumaric, maleic, crotonic, itaconic, or citraconic acids and partial esters of $\alpha,\beta$-ethylenically unsaturated polymeric acids such as methyl acid maleate, ethyl acid fumarate, vinyl sulfonate, 2-sulfoethylacrylate, and 2-sulfoethylmethacrylate.

In addition to the polymers described above, the polymeric acids or salts thereof of this invention may be copolymers of nonionic and anionic monomers. Examples of water-soluble anionic monomers are those listed above. Examples of water-soluble nonionic monoethylenically unsaturated monomers include acrylamide, methacrylamide, N-isopropylacrylamide, N-methylol acrylamide, hydroxyethyl acrylate, hydroxyethylmethacrylate and acrylonitrile. Examples of monomers containing both nonionic and anionic moieties are N-acrylamide glycolic acid, N-methacrylamide glycolic acid and N-methylolacrylamido-N-glycolic acid.

In addition to the polymerization or copolymerizations described above, the depressants of the present invention may also be prepared by first polymerizing a nonionic monomer and then hydrolyzing some of the nonionic groups to carboxylic acid. For example, acrylamide may be polymerized by conventional techniques and some of the amide groups may be hydrolyzed to carboxylic acid by known methods. Examples of reagents useful for the hydrolysis include NaOH, KOH and $NH_4OH$.

In a particularly preferred embodiment, the polymeric acid of this invention is polyacrylic acid or polystyrene sulfonic acid. When the polymer is in the salt form, it is preferred that the counterion is a Group I metal ion or an ammonium ion. It is more preferred that the counterion be Na or K. It is most preferred that the polyacrylic acid or polystyrene sulfonic acid be in salt form and that the counter ion be sodium.

The polymeric acids or salts thereof useful in the practice of this invention may be of any molecular weight so long as they have the effect of depressing the flotation of the inorganic sulfur and have no significant impact on the flotation of coal and so long as they possess essentially no flocculating properties. It is preferred that the average molecular weight be less than about 40,000. It is more preferred that the average molecular weight be less than about 25,000 and it is most preferred that it be less than about 15,000. It is preferred that the average molecular weight be greater than about 500 and more preferred that it be greater than about 2000. It is most preferred that the average molecular weight of the polymeric acid or salt thereof be greater than about 4000.

Any amount of depressant which will depress the flotation of the inorganic sulfur may be used in the practice of this invention. Generally, the amount of depressant needed will vary depending on the conditions of the flotation process and the degree of hydrolysis of the depressant. Other factors which will affect the amount of depressant which will be useful in the practice of this invention include the type of coal subjected to flotation and the amount of inorganic sulfur-containing compounds present with the coal. It is preferred that at least about 0.01 kilogram of depressant is used per metric ton of coal to be floated. It is more preferred that at least 0.025 kilogram of depressant is used per metric ton of coal to be floated. It is preferred that no more than about 1 kilogram of depressant is used per metric ton of coal to be floated and more preferred that no more than about 0.5 kilogram of depressant be used per metric ton of coal to be floated.

The depressants useful in the practice of this invention are effective when used in conjunction with a wide variety of collectors and frothers useful in coal flotation. When the coal to be floated is oxidized or otherwise difficult to float, promoters may be used to increase the efficiency of the collectors. Examples of collectors useful in the froth flotation of coal include fuel oils, kerosene, naphtha and other hydrocarbons. Materials such as amines, fatty acid amine condensates and surfactants containing multiple ethylene oxide or propylene oxide moieties are examples of promoters. Examples of frothers useful in coal flotation include pine oils, eucalyptus oils, alcohols containing 5 to 12 carbons, cresols, $C_1$ to $C_4$ alkyl ethers of polypropylene glycols, dihyroxylates of polypropylene glycols and glycols. The selection of appropriate collectors and frothers will be made by one skilled in the art based on the circumstances of the particular flotation process. For discussions of frothers and collectors useful in coal flotation, see Klimpel et al., *Fine Coal Processing,* S. K. Mishra and R. R. Klimpel, eds., Noyes Publishing, Park Ridge, N.J., pp. 78–108 (1987) and Laskowski et al., *Reagents in the Mineral Industry–Rome Meeting,* Inst. of Min. Met., M. J. Jones and R. Oblatt, eds., pp. 145–154 (1984), hereby incorporated by reference.

The depressant may be added at any stage of the separation process so long as it is added prior to the flotation step. It is preferred to add the depressant before or with the addition of the collector, if any collector is to be added. It is more preferred to add the depressant before the addition of the collector, if any.

The coal flotation process of this invention may be performed at any pH at which tee polymeric acid depressants of this invention will selectively depress the flotation of inorganic sulfur-containing compounds. For convenience, it is usually preferred that no pH regulators such as lime are added and that the flotation is performed at the natural pH of the coal feed which is typically at least about 4.0 and no greater than about 8.5. However, in some situations, it is preferable to adjust the pH to optimize the effect of the depressants of this invention. For example, if the coal being subjected to flotation is particularly high in sulfur-containing compounds, the cost of adjusting pH may be offset by the increase in the amount by which the flotation of inorganic sulfur-containing compounds is depressed. In those instances where it is desirable to optimize the amount by which the flotation of inorganic sulfur-containing compounds is depressed, it is preferred to perform the coal flotation process of this invention at a pH of at least about 5.5 and no greater than about 8.5.

The process of this invention may be practiced using various sized particles of raw coal as long as sufficient size reduction occurs prior to the flotation process. Sufficient size reduction is obtained when the majority of coal and gangue, such as pyrite, particles exist as physically distinct particles or as particles existing in a loose agglomeration. Unless the particles exist in this physically separate form, they cannot be separated by flotation. It is generally necessary to grind and/or mill the raw coal to attain sufficient size reduction of the particles prior to the actual flotation. Coal may be ground dry, semi-dry or in slurry form. When coal is ground in slurry form, the slurry generally contains at least about 50 weight percent solids. Various raw coals require different degrees of grinding to achieve sufficient size reduction depending on the geological history of the coal formation. It is generally preferable that raw coal particles be sized to at least about 10 percent of the particles smaller than 75 micrometers to about 90 per cent smaller than 75 micrometers for flotation.

The ground coal is slurried with water prior to being subjected to the flotation process. It is preferred that the solids content of the aqueous coal slurry is at least about 2 weight percent and no greater than about 30 weight percent.

The depressants useful in the practice of this invention depress the flotation of inorganic sulfur-containing compounds. By inorganic sulfur-containing compounds is meant inorganic compounds normally associated with coal which are primarily metal-sulfur compounds, preferably iron-sulfur compounds. Examples of iron-containing compounds include pyrite ($FeS_2$), marcasite and pyrrhotite. It is preferred that the inorganic sulfur-containing compound separated from the desired coal be pyrite.

The degree by which the flotation of inorganic sulfur-containing compounds is depressed by the practice of this invention is any which will allow an improved separation of the inorganic sulfur-containing compounds from the coal. Two factors are important in observing this improvement. The primary factor is that the amount of inorganic sulfur-containing compounds floated with the coal is minimized. The second factor is that the amount of clean coal recovered is optimized. The relative importance of these two factors may vary in different situations. It will be recognized by those skilled in the art that in some situations, it will be desirable to minimize the amount of sulfur-containing compounds recovered even if the recovery of clean coal is also affected. An example of such a situation is when coal contains a level of sulfur-containing compounds so high that the coal is effectively not usable. In such a situation, a significant reduction in the amount of inorganic sulfur-containing compounds is desirable even when accompanied by a reduction in the overall amount of clean coal recovered.

It is preferred that the flotation of inorganic sulfur-containing compounds is depressed by at least about five percent by the use of the polymeric depressants of this invention. It is more preferred that the flotation of the inorganic sulfur-containing compounds is depressed by at least about ten percent.

The following examples are provided by way of illustration and are not given to limit the invention in any way. Unless stated otherwise, all parts and percentages are given by weight.

EXAMPLES 1–3 AND COMPARATIVE EXAMPLES C-1 and C-2—SODIUM POLYACRYLATE AS A DEPRESSANT Coal from the Lower Freeport Seam is crushed and the size fraction between 0.75 inch and 10 mesh (U.S. Standard) is split successively through a riffle splitter and a carousel packaging device and packaged into about 200-g samples. The coal in these samples contains about 5 weight percent pyrite which is equivalent to about 2.7 weight percent sulfur. The samples are stored in a freezer prior to use to retard oxidation.

Prior to flotation, a 200-g sample of coal prepared as described above is placed in a rod mill with a diameter of 8 inches and a length of 9.5 inches. Eight 1-inch diameter stainless steel rods are also placed in the rod mill. A sodium polyacrylate flotation depressant having an average molecular weight of about 9000, when used, and 500 ml of deionized water are added at this time. The coal is milled for 300 revolutions at 60 revolutions per minute (RPM) and then the slurry is transferred to a 3-liter cell of an Agtair flotation machine. Deionized water is added to the cell to bring the volume to the mark and the pH is measured. Any adjustments to pH are made at this time by the addition of NaOH solution. A purified kerosene collector is added in an amount equivalent to 1.0 kilogram of collector per metric ton of raw coal feed and the slurry is conditioned for one minute with agitation. A frother, a methyl ether of a polypropylene oxide having a molecular weight of about 400, is added next in an amount equivalent to 0.1 kilogram per metric ton of raw coal feed. The slurry is again conditioned for one minute and then air is introduced into the flotation cell at a rate of 9 liters per minute. A motorized paddle rotating at 10 RPM is turned on and sweeps the coal laden froth from the lip of the float cell into a collector tray. Froth is collected in two portions, the first for 30 seconds after the start of flotation and the second for the next 3.5 minutes.

The froth concentrates and the non-floated material, the tailings, are oven dried overnight at 110° C. They are then weighed and samples are taken for analysis.

The ash content of each froth concentrate and tailing sample is determined by ignition of a one-gram portion at 750° C. in a muffle furnace. The clean coal recovery is then calculated by the following formula: Percent of Clean Coal Recovery $=[A/(A+B)]\times 100$ where A is the amount of recovered coal in the froth concentrate minus the amount of ash in the froth concentrate and B is the amount of coal in the tailings minus the amount of ash in the tailings. That is, the clean coal recovery is the percentage of the coal present before the coal is treated that is actually recovered.

The inorganic sulfur content of the coal sample is determined by analyzing a weighed portion of each sample. The sample is analyzed for Fe and the percentage of Fe content is related to sulfur content since the sulfur is present in the form of pyrite ($FeS_2$). The weighed portion of the sample is oxidized by a nitric acid solution and then is digested in a sulfuric acid solution. The solution is then diluted to a standard volume and the iron content is determined with a DC Plasma Spectrometer. The percent iron pyrite remaining with the coal which is equivalent to the percent of inorganic sulfur remaining with the coal is then calculated as the iron content of the froth concentrate divided by the iron content of the concentrate plus the iron content of the non-floated tailings. This amount is multiplied by 100 to obtain the percentage. Thus, the pyrite remaining is the percent of pyrite originally present in the untreated coal that remains with the coal after the flotation process.

The results obtained are given in Table I below.

TABLE I

| Example | Depressant[1] (kg/ton) | pH | % Clean Coal Recovery[2] | % Reduction in Clean Coal Recovery[3] | % Pyrite Remaining[4] | % Reduction in Pyrite Remaining[5] |
|---|---|---|---|---|---|---|
| C-1 | none | 4.2 | 54.9 | — | 28.6 | — |
| 1 | 0.025 | 4.1 | 55.8 | (1.6)[6] | 27.0 | 5.6 |
| 2 | 0.25 | 4.2 | 51.1 | 7.0 | 22.2 | 22.4 |
| C-2 | none | 8.0 | 60.5 | — | 26.9 | — |
| 3 | 0.025 | 8.0 | 51.2 | 15.4 | 19.1 | 30.0 |

[1]$Na^+$ salt of polyacrylic acid with average molecular weight of about 9000
[2]Percentage of coal that is originally present that is recovered after treatment
[3]Percentage by which clean coal recovery is reduced by the use of the polymeric acid depressant
[4]Percentage of pyrite originally present that remains with the recovered clean coal
[5]Percentage by which pyrite remaining is reduced by the use of the polymeric acid depressant
[6]In this case the amount of clean coal recovered is increased The data in the above table clearly demonstrate that the presence of the depressant of this invention in the flotation process results in a separation of coal from inorganic sulfur-containing compounds that is improved over the separation obtained when no depressant is used. This improved separation is accomplished with only minimal reduction in the overall mount of coal recovered. A comparison of Examples 1 and 2 demonstrates the effect of dosage. The depressant has a greater effect at higher dosages on both the amount of pyrite remaining and clean coal recovery, but the percentage by which the pyrite remaining is decreased is substantially larger than the percentage by which the clean coal recovery is decreased. The effect of pH is demonstrated in Comparative Example 2 and in Example 3 showing that at the higher pH the ability of the depressants of this invention to depress the flotation of inorganic sulfur-containing compounds is enhanced.

EXAMPLES C-3 and 4—EFFECT OF SIZE OF COAL PARTICLES

The general procedure outlined above is followed with two major exceptions. The size fraction of coal used is that which is finer than 10 mesh (U.S. Standard). This size fraction contains about 7 weight percent pyrite which represents almost 4 weight percent sulfur. Further, the pyrite present is more finely divided than in the previous examples and thus is more difficult to remove. In this case, the coal is only ground in the rod mill for 60 revolutions rather than for 300 revolutions as it was in the previous examples. The pH is 8.0 in each case. The results obtained are shown in Table II below.

TABLE II

| Example | Depressant[1] (kg/ton) | % Clean Coal Recovery[2] | % Reduction in Clean Coal Recovery[3] | % Pyrite Remaining[4] | % Reduction in Pyrite Remaining[5] |
|---|---|---|---|---|---|
| C-3 | none | 81.2 | — | 45.6 | — |
| 4 | 0.025 | 78.4 | 3.4 | 42.0 | 7.8 |

[1]$Na^+$ salt of polyacrylic acid with average molecular weight of about 9000
[2]Percentage of coal that is originally present that is recovered after treatment
[3]Percentage by which clean coal recovery is reduced by the use of the polymeric acid depressant
[4]Percentage of pyrite originally present that remains with the recovered clean coal
[5]Percentage by which pyrite remaining is reduced by the use of the polymeric acid depressant The data in Table II show that good separation of sulfur-containing particles is also obtained when the sulfur content of the coal is higher and the sulfur-containing compounds as well as the coal itself exists in a more finely divided state.

EXAMPLES C-4 and 5-13—EFFECT OF DEPRESSANT IDENTITY AND SIZE OF COAL PARTICLES The general procedure specified for Examples C-3 and 4 is followed using the −10 mesh size fraction of coal with the higher sulfur content. In this case, the coal is ground 120 revolutions in the rod mill rather than 60 revolutions as in the previous example. The pH is also 8.0 in each example. The results obtained are shown in Table III below.

TABLE III

| Example | Depressant (kg/ton) | % Clean Coal Recovery[1] | % Reduction in Clean Coal Recovery[2] | % Pyrite Remaining[3] | % Reduction in Pyrite Remaining[4] |
|---|---|---|---|---|---|
| C-4 | none | 74.1 | — | 33.8 | — |
| 5[5] | 0.025 | 74.0 | 0.1 | 30.0 | 11.2 |
| 6[6] | 0.025 | 72.4 | 2.3 | 27.5 | 18.6 |
| 7[7] | 0.025 | 71.9 | 3.0 | 27.7 | 18.0 |
| 8[8] | 0.025 | 72.9 | 1.6 | 28.5 | 15.7 |
| 9[9] | 0.025 | 72.2 | 2.6 | 32.9 | 2.7 |
| 10[10] | 0.025 | 71.9 | 3.0 | 32.1 | 5.0 |
| 11[11] | 0.025 | 68.8 | 7.1 | 28.6 | 15.4 |
| 12[12] | 0.025 | 73.7 | 0.5 | 28.5 | 15.7 |
| 13[13] | 0.025 | 70.3 | 5.1 | 28.8 | 14.8 |

[1]Percentage of coal that is originally present that is recovered after treatment
[2]Percentage of which clean coal recovery is reduced by the use of the polymeric acid depressant
[3]Percentage of pyrite originally present that remains with the recovered clean coal
[4]Percentage by which pyrite remaining is reduced by the use of the polymeric acid depressant
[5]50% acrylate/50% acrylamide copolymer (MW 9000)
[6]Sulfoethylmethylacrylate (MW 9000)
[7]8% acrylate/92% acrylamide copolymer (MW 9000)
[8]50% 2-acrylamide-2-methyl-1-propanesulfonic acid/50% acrylamide copolymer (MW 9000)
[9]30% Sulfoethylmethacrylate/70% acrylamide copolymer (MW 9000)
[10]Sulfonated polyacrylamide (MW 30,000)
[11]$Na^+$ salt of styrene/maleic anhydride/vinyl benzyl ether (MW 12,000)
[12]Polystyrene sulfonic acid (MW 10,000)
[13]$NH_4^+$ salt of polyacrylic acid (MW 20,000)

A comparison of Examples C-3 in Table II and C-4 in Table III demonstrates the effect of milling the coal for 120 revolutions (C-4) rather than 60 revolutions (C-3). The amount of coal recovered and the amount of pyrite remaining are each decreased in C-4, but the amount of pyrite remaining in decreased by a significantly larger percentage. This indicates that with the additional milling, a slightly smaller amount of clean coal is recovered, but that it contains significantly less sulfur. The data in Examples 5–13 clearly demonstrate that the depressants of this invention are effective in depressing the flotation of inorganic sulfur-containing compounds in the flotation of relatively finely milled coal containing relatively high percentages of inorganic sulfur-containing compounds.

What is claimed is:

1. A process for the depression of the flotation of inorganic sulfur-containing compounds in coal flotation which comprises subjecting raw coal, which contains inorganic sulfur-containing compounds and has undergone sufficient size reduction so that the majority of the coal particles and particles of the inorganic sulfur-containing compounds exist as physically distinct particles or as particles in a loose agglomeration and is in the form of an aqueous slurry, to a froth flotation process in the presence of an amount of a polymeric acid or a salt thereof having an average molecular weight of less than about 40,000, which contains a plurality of pendant anionic moieties, effective to depress the flotation of the inorganic sulfur-containing compounds.

2. The process of claim 1 wherein the pendent anionic moieties are selected from the group consisting of carboxylic and sulfonic moieties.

3. The process of claim 1 wherein the polymeric acid is in the form of a salt.

4. The process of claim 3 wherein the salt of the polymeric acid is sodium polyacrylate.

5. The process of claim 3 wherein the salt of the polymeric acid is the sodium salt of polystyrene sulfonic acid.

6. The process of claim 3 wherein the salt of the polymeric acid is a copolymer of acrylate and acrylamide.

7. The process of claim 3 wherein the salt of the polymeric acid is a copolymer of 2-acrylamido-2-methyl-1-propanesulfonate and acrylamide.

8. The process of claim 3 wherein the salt of the polymeric acid is a sulfoethylmethacrylate.

9. The process of claim, 1 wherein the polymeric acid or salt thereof has an average molecular weight greater than about 2000 and less than about 25,000.

10. The process of claim 9 wherein the polymeric acid or salt thereof has an average molecular greater than about 4000 and less than about 15,000.

11. The process of claim 1 wherein the depressant is added to tee flotation system at a level of between at least about 0.01 kilogram and no greater than about 1 kilogram of depressant per metric ton of raw coal treated.

12. The process of claim 11 wherein the depressant is present at a level of at least about 0.025 and no greater than about 0.5 kilogram of depressant per metric ton of raw coal treated.

13. The process of claim 1 wherein the inorganic sulfur-containing compound is pyrite.

14. The process of claim 1 wherein the coal flotation is carried out at the natural pH of the raw coal feed.

15. The process of claim 1 wherein the coal flotation is carried out at a pH of about 8.0.

16. The process of claim 1 wherein the raw coal is size reduced to at least about 10 percent of the particle smaller than 75 micrometers.

17. The process of claim 1 wherein the raw coal is size reduced to at least about 90 percent of the particles smaller than 75 micrometers.

* * * * *

UNITED STATES PATENT AND TRADEMARK OFFICE

CERTIFICATE OF CORRECTION

PATENT NO. : 4,830,740

DATED : May 16, 1989

INVENTOR(S) : Richard R. Klimpel and Robert D. Hansen

It is certified that error appears in the above-identified patent and that said Letters Patent is hereby corrected as shown below:

Col. 2, line 15, insert a period after "agglomeration".

Col. 5, line 10, "tee" should read -- the --.

Col. 7, line 66, "mount" should read -- amount --.

Col. 9, Table III, Footnote 2, the first occurrence of "of" should read -- by --.

Col. 10, line 43, "tee" should read -- the --;

line 58, "particle" should read -- particles --.

Signed and Sealed this

Seventh Day of August, 1990

*Attest:*

HARRY F. MANBECK, JR.

*Attesting Officer*

*Commissioner of Patents and Trademarks*